United States Patent [19]

Olsson

[11] 4,315,663

[45] Feb. 16, 1982

[54] MULTIPLE POSITION BRUSH CONNECTOR

[75] Inventor: Billy E. Olsson, New Cumberland, Pa.

[73] Assignee: AMP, Inc., Harrisburg, Pa.

[21] Appl. No.: 128,775

[22] Filed: Mar. 10, 1980

[51] Int. Cl.[3] ..... H01R 13/00

[52] U.S. Cl. ..... 339/97 P; 339/17 M

[58] Field of Search ..... 339/17 LM, 17 M, 97 R, 339/97 P, 99 R, 252 R, 176 M, 276 SF

[56] References Cited

U.S. PATENT DOCUMENTS

| | | | |
|---|---|---|---|
| 3,107,319 | 10/1963 | Vizzier, Sr. | 339/17 LM |
| 3,633,152 | 1/1972 | Podmore | 339/99 R |
| 3,727,175 | 4/1973 | Grenda | 339/276 SF |
| 3,757,277 | 9/1973 | Yamanoue et al. | 339/176 M |
| 3,816,818 | 6/1974 | Meier | 339/99 R |
| 3,902,776 | 9/1975 | Williams et al. | 339/276 SF |
| 3,924,923 | 12/1975 | Shoemaker | 339/278 M |
| 3,963,319 | 6/1976 | Shumacher et al. | 339/176 MF |
| 4,036,545 | 7/1977 | Mysiak | 339/95 D |
| 4,066,320 | 1/1978 | Goodrich et al. | 339/98 |
| 4,113,338 | 9/1978 | Spaulding | 339/97 R |
| 4,125,311 | 11/1978 | Hoppe, Jr. | 339/97 R |
| 4,133,596 | 1/1976 | Dauser, Jr. | 339/98 |

FOREIGN PATENT DOCUMENTS

| | | | |
|---|---|---|---|
| 1007316 | 3/1977 | Canada | 339/97 P |
| 1640630 | 10/1969 | Fed. Rep. of Germany | 339/97 R |
| 1490440 | 11/1969 | Fed. Rep. of Germany | 339/17 LM |
| 2604269 | 8/1976 | Fed. Rep. of Germany | 339/97 R |

*Primary Examiner*—Joseph H. McGlynn
*Attorney, Agent, or Firm*—Richard B. O'Planick

[57] ABSTRACT

A brush connector for interconnecting plural leads to conductive actuator pads is disclosed comprising an insulative housing and a plurality of contact members. The housing is adapted having a row of elongate cavities profiled to facilitate top loading of contact members and bottom insertion of a plurality of conductors therein, whereupon depending insulation piercing portions of the contact members establish electrical engagement with the conductors. Each housing cavity is further profiled to accommodate a downward deflection of spring arm portions of the contact members, and the housing provides integral interior surfaces to support said contact upon deflection of the contact spring arms.

8 Claims, 5 Drawing Figures

Fig. 4
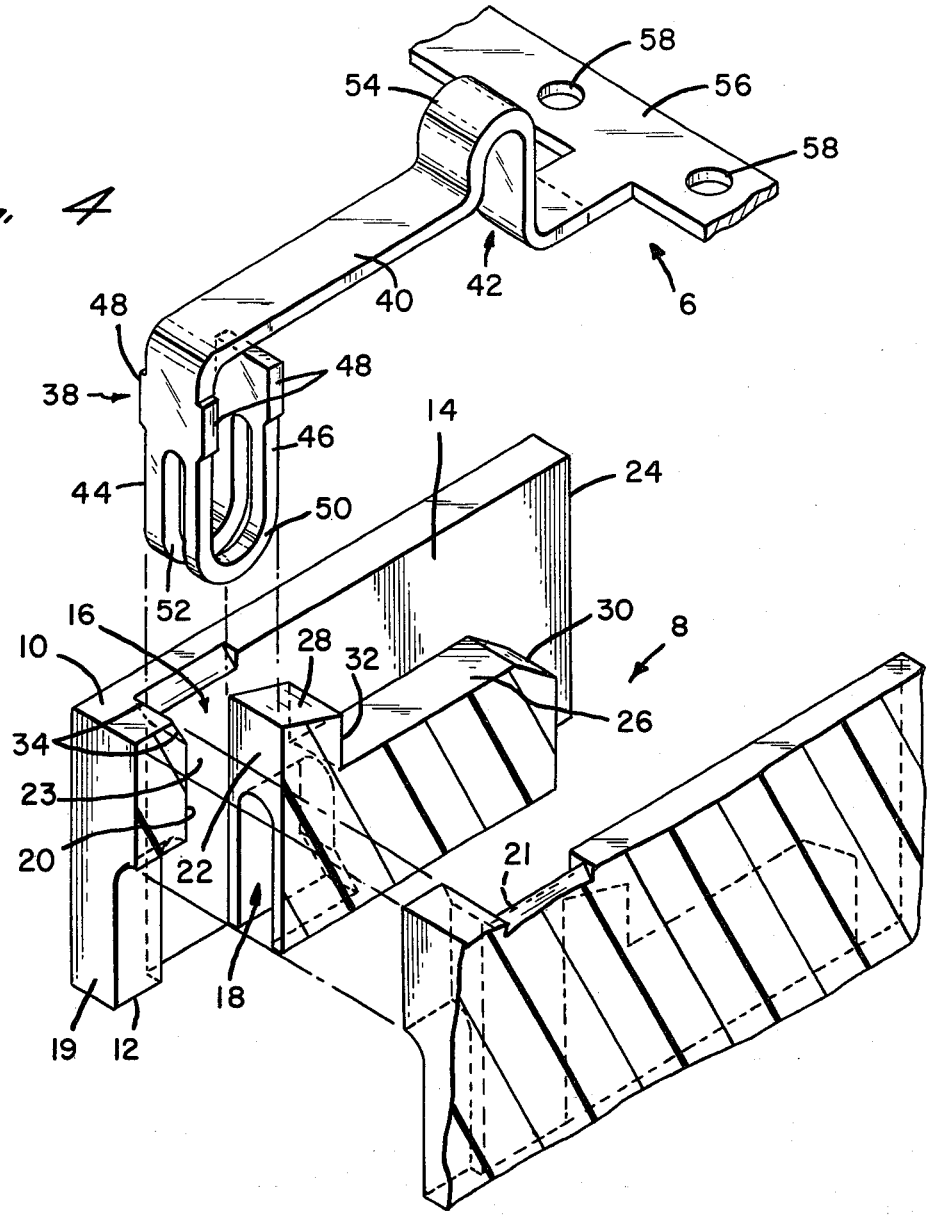
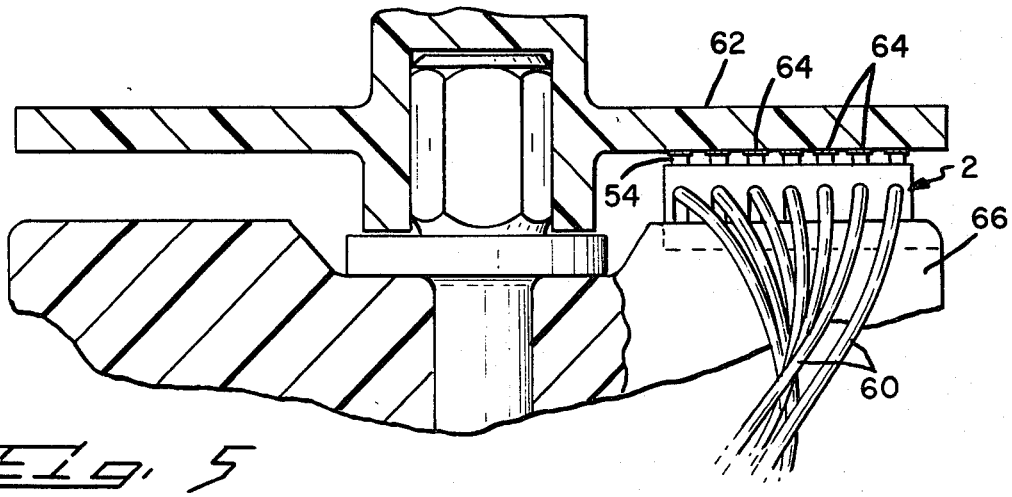
Fig. 5

MULTIPLE POSITION BRUSH CONNECTOR

BACKGROUND OF THE INVENTION

1. The Field of the Invention

The present invention relates generally to brush connectors for interconnecting a plurality of conductors to conductive actuator pads. More specifically, the present invention relates to brush connectors which utilize insulation displacement technology in achieving said interconnection.

2. The Prior Art

Presently available connector assemblies for interconnecting plural conductors to circular conductive pads on a rotating actuator unit are of a multi-piece configuration. Typically such assemblies comprise a separate first connector for terminating the conductors, and a secondary unit, mateable with the first connector, locateable in a semi-permanent connection with an actuator mechanism. While this multi-piece assembly approach is functional and has met with acceptance in the industry, certain shortcomings are readily apparent. One problem is that available multi-piece brush connectors are relatively expensive and difficult to make. Secondly, such assemblies provide less than adequate protection of the contacts during handling since the contacts which interconnect the first and second connector components are ordinarily exposed. Moreover, assembly of the connectors is manually intensive, further adding to the cost of the product.

Accordingly, the industry has been in need of a single unitary brush connector assembly which is economical to produce, yet which provides adequate protection of the contacts utilized therewith. Ideally, a brush connector should accommodate mass loading of contact members therein, and the contact members themself should preferably achieve termination of the conductors in an efficient manner, such as by an insulation displacement technique.

SUMMARY OF THE PRESENT INVENTION

The present invention relates to an economically produced brush connector for interconnecting plural leads to conductive actuator pads. The brush connector is of a unitary configuration, comprising an insulative housing and a plurality of contact members. A row of elongate cavities are provided in the connector housing, each profiled to facilitate top loading one contact member and bottom insertion of an insulated conductor therein. The contact members are structured having depending insulation piercing portions which electrically engage the conductors upon lateral insertion of the conductors into the connector housing. Each housing cavity is further profiled to accommodate downward deflection of the spring arm portions of the contact members therein, and the housing provides integral interior surfaces which protect the contact members and lend support for downward deflection of the contact spring arms.

Accordingly, it is an object of the present invention to provide a brush connector for interconnecting plural leads to conductive actuator pads.

It is a further object of the present invention to provide a brush connector for interconnecting plural leads to conductive actuator pads, featured having a housing block of a unitary configuration.

Still a further object of the present invention is to provide a brush connector featured having structural means for protecting contact members utilized therewith.

Yet a further object of the present invention is to provide a brush connector which is suited for semi-automatic assembly.

Still further, it is an object of the present invention to provide a brush connector featured having housing block cavities profiled to facilitate mass loading of contact members therein, and integral housing means for supporting a deflection of spring portions of said contact members.

Another object of the present invention is to provide a brush connector for interconnecting plural leads to conductive actuator pads which is economically and readily produced.

These and other objects, which will be apparent to one skilled in the art, are achieved by a preferred embodiment which is described in detail below, and which is illustrated by the accompanying drawings.

BRIEF DESCRIPTION OF THE ACCOMPANYING DRAWINGS

FIG. 4 is a perspective view of one contact member exploded from an associate one connector housing cavity. A portion of the connector housing cavity is broken away for the purpose of added clarity.

FIG. 5 is a section view through an actuator mechanism having a plurality of circular conductive pads thereupon. The subject brush connector pursuant to the present invention is illustrated in contacting engagement with the conductive circular pads of the actuator.

DETAILED DESCRIPTION OF THE PREFERRED EMBODIMENT

Figure 1:
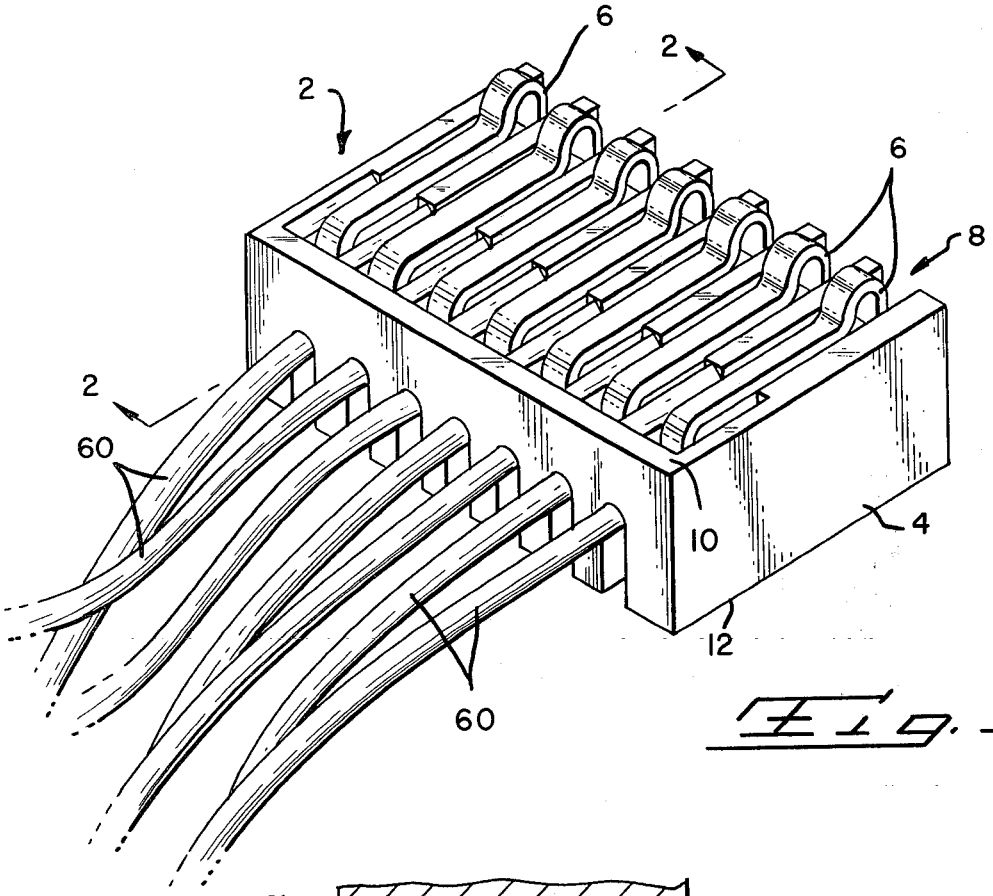
FIG. 1 is a perspective view of the subject brush connector in the assembled state.

Referring first to FIG. 1, the subject brush connector assembly 2 is shown as comprising a seven position housing block 4, and a plurality of contact members 6 loaded into profiled contact-receiving cavities 8 of the housing block 4. The contact-receiving cavities 8 extend into a top surface 10 of the housing block 4, toward a bottom surface 12. As illustrated by FIG. 4, each contact-receiving cavity 8 comprises a forward elongate channel 14, a depending contact retention chamber 16, and a conductor receiving bottom channel 18 extending in communication with the bottom surface 12 and opening to a rearward end 19 of the housing. A pair of opposing interior walls 20, 21, 22, and 23 define the contact retention chamber 16. The elongate forward channel 14 opens to a forward end 24 of the connector housing, and terminates interiorly of the housing at a step profiled floor surface 26.

The floor surface 26 is profiled having an upper beveled tier 28, and a forward beveled portion 30, each of which sloping downwardly toward the forward end 24 of the housing. The upper beveled tier 28 and the mid portion of floor surface 26 are contiguously joined by an integral step 32. As shown, chamfered entries 34 are provided in the upper surface 10 of the connector housing extending into the contact retention chamber 16. An additional chamfer 36 (FIG. 2) is provided in the bottom surface 12 of the connector housing partially defining the conductor receiving bottom channel 18.

With continuing reference to FIG. 4, each contact member 6 comprises a conductor engaging U-shaped rearward portion 38, an intermediate shank portion 40, and a forward serpentine profiled integral end 42. The rearward portion 38 consists of parallel leg segments 44, 46, each having a pair of outwardly projecting interference side flanges 48, and a bight portion 50 into which an insulation displacement slot 52 partially extends. The forward end 42 of the contact member 6 has a generally serpentine profile, including an upwardly projecting contact shoulder 54. The forward end 42 is integrally connected to a carrier strip having a series of apertures 58 therein. The contact members 6 can be mass produced in strip form, and presented to the connector housing by automatic assembly equipment (not shown), which advances the carrier strip by means of the apertures 58.

Referring again to FIG. 1, the subject brush connector assembly is intended to terminate a plurality of insulated conductors 60.

Assembly of the subject invention proceeds as follows with reference to FIGS. 1–4. A series of seven contact members are presented to the connector housing, and mass inserted into the contact-receiving cavities 8 by means of automatic equipment commonly available in the industry. Each contact 6 is press fit into one housing cavity 8 and retained therein by an interference fit achieved by embedding engagement of the contact member side flanges 48 into the interior walls 21, 23 of the housing. It will be appreciated that this interference fit is located in the upper portion of the rearward displacement part 38 of the contact member where the material is solid. Since the contact is stamped in strip form with the carrier attached beyond the forward contact portion 42, multiple insertion of contacts into the housing may be achieved with subsequent cutoff of the carrier strip. The open ended configuration of the contact-receiving cavities 8 facilitate such an insertion.

Figure 2:
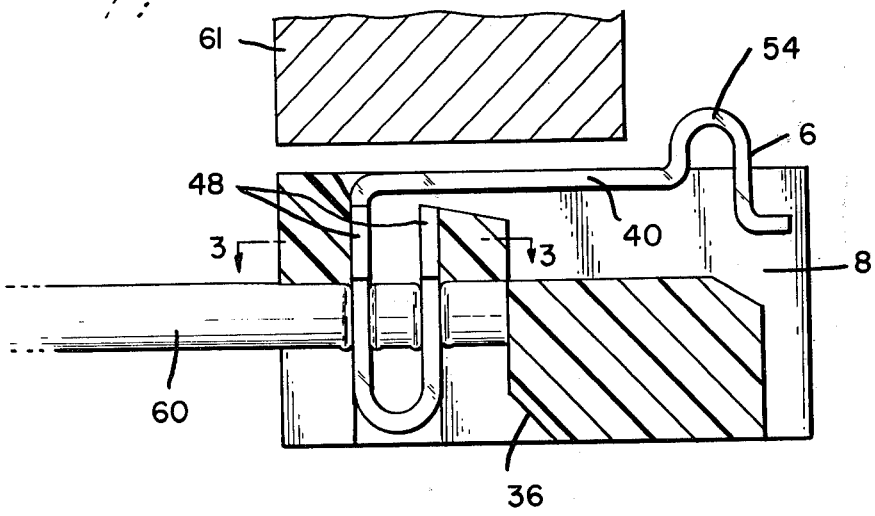
FIG. 2 is a transverse section view taken through the assembled brush connector illustrated in FIG. 1, taken along the line 2—2 illustrating the termination of a single conductor by one contact member.
Figure 3:
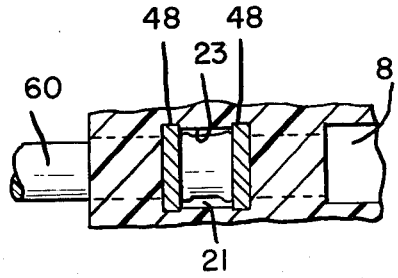
FIG. 3 is a top planar view taken along the line 3—3 of FIG. 2, illustrating the force fit engagement between the contact member and the housing, and the termination of a single conductor in the insulation piercing slot of the contact member.

From FIG. 2, some general observations will be apparent. First, the spring arm 40 of the contact member 8 does not protrude from the top surface 10 of the housing; only the contact portion 54 projects beyond the top surface 10 of the housing. The contacts are therefore well protected within their respective housing cavities. The connector housings, moreover, can be fed end to end into an automatic machine which simultaneously feeds, terminates, and cuts seven conductors 60 if so desired. Finally, it will be appreciated that the interior walls 20, 22, of the connector housing provide essential support for the deflection of each contact spring arm 40 into a respective housing cavity portion 14. It will be apparent that the surfaces 30, 28, slope to provide sufficient clearance for the deflection of the contact member arms 40 into their respective cavities.

With reference to FIGS. 2, 4, seven conductors are simultaneously terminated to the connector from a bottom direction, with each conductor laterally introduced into a respective conductor receiving bottom channel 18. The chamfer 36 facilitates a smooth insertion of the conductor 60 into the channel. Upon insertion, each conductor enters the insulation displacement slot 52 of an associate contact member, whereupon, electrical engagement between the contact member and the center conductor is effectuated. It will be appreciated that appropriate tooling, as indicated at numeral 61, may be provided to lend superior support to shank portion 40 of the contact member 6 during the insertion of the conductor 60 into the slot 52. Such support is readily facilitated by virtue of the contact arm 40 being substantially in the plane of the top surface 10 of the connector housing. As shown, the terminated conductors exit from the rearward end of the connector housing.

Referring now to FIG. 5, the assembled brush connector assembly is intended for use with an actuator, consisting of a pivoting actuator arm 62 having a plurality of circular conductor pads 64 on a bottom surface thereof. A support base 66 is further provided, with a connector receiving space being thereby defined between the upper actuator arm 62 and the bottom support base 66. The subject brush connector is intended for insertion into the space, whereby the contact member shoulders 54 engage the circular conductive pads 64 of the actuator arm and establish electrical contact therewith. While the present brush connector assembly finds particular application in interconnecting with an actuator of the type depicted in FIG. 5, the principles of the present invention are not to be so confined. Other embodiments, or applications which will be apparent to one skilled in the art and which utilize the teachings herein set forth are intended to be within the scope and spirit of the subject invention.

What is claimed is:

1. A brush connector for electrically terminating insulated conductors, comprising:

a connector housing having at least one profiled elongate cavity extending downwardly into a top surface thereof, one end of each said cavity extending through said housing to a bottom housing surface;

at least one profiled contact member seated within said one housing cavity and having a downwardly deflectable horizontal spring arm projecting along said one cavity substantially in the plane of said top housing surface, and rearward conductor engaging means depending from a rearward end of said spring arm into said one end of said cavity, said one end of said cavity comprising an upper constructed passageway defined by opposing interior housing surfaces, and an elongate counterchannel opening to and extending parallel with said bottom housing surface and dimensioned to closely receive one of said conductors laterally therein, parallel of said bottom housing surface.

2. A brush connector as set forth in claim 1, wherein said rearward portion of each said contact member comprising a U-shaped beam having first and second leg segments in abutment against said interior housing surfaces, and a bight portion projecting downwardly into said elongate counterchannel, and said bight portion having an insulation piercing slot extending therein.

3. A brush connector for electrically terminating insulated conductors, comprising:

a connector housing having at least one profiled elongate cavity extending downwardly into a top surface thereof, one end of each said cavity extending through said housing to a bottom housing surface;

at least one profiled contact member seated within said one housing cavity and having a downwardly deflectable horizontal spring arm projecting along said one cavity substantially in the plane of said top housing surface, and rearward conductor engaging means depending from a rearward end of said spring arm into said one end of said cavity, said connector housing having floor surface means downwardly extending from said one end of each said cavity toward a forward end of said housing for terminating downward deflection of said spring arm and, whereby said cavity is of increasing depth toward said forward housing end to accept a deflection of said spring arm downwardly therein.

4. A brush connector as set forth in claim 3, wherein each said cavity opens to said forward end of said housing.

5. A brush connector for electrically interconnecting insulated conductors with conductive pad means, comprising:

an insulative housing block having at least one profiled elongate cavity extending downwardly into a top surface thereof and opening to a forward end of said housing, and having terminating surface means within said cavity, with a rearward end of said cavity comprising an upper constructed passageway defined by opposing interior housing surfaces, and an elongate bottom counterchannel opening to a bottom surface of said housing block, at least one profiled contact member seated within said one housing cavity and having a downwardly deflectable horizontal spring arm projecting along said one cavity substantially in the plane of said top housing surface, said spring arm engaging said terminating surface means to conclude said downward deflection, and depending conductor engaging means seated within said upper constricted passageway and having insulation displacement means projecting downwardly into said bottom counterchannel.

6. A brush connector as set forth in claim 5, wherein said conductor engaging means comprising first and second spaced apart parallel leg segments in abutment against said interior housing surfaces, and said insulation displacement means comprising a bight portion integrally connecting bottom ends of said leg segments, and having a profiled insulation displacement slot extending therein.

7. A brush connector as set forth in claim 5, wherein said contact member horizontal spring arm having an integral forward segment of serpentine profile, adapted having one portion projecting upwardly from said top housing surface.

8. A brush connector as set forth in claim 5, wherein said terminating surface means comprising a floor surface sloping downwardly from said one end of said cavity toward a forward end of said housing.

* * * * *